US005141007A

United States Patent [19]

Raker et al.

[11] Patent Number: 5,141,007

[45] Date of Patent: Aug. 25, 1992

[54] CIGARETTE

[75] Inventors: Mark L. Raker, Clemmons; Thomas L. Gentry, Winston-Salem; Barbara W. Arzonico, Lewisville, all of N.C.

[73] Assignee: R. J. Reynolds Tobacco Company, Winston-Salem, N.C.

[21] Appl. No.: 610,618

[22] Filed: Nov. 8, 1990

[51] Int. Cl.[5] ..... A24D 1/02

[52] U.S. Cl. ..... 131/358; 131/365; 131/336

[58] Field of Search ..... 131/358, 331, 336, 365

[56] References Cited

U.S. PATENT DOCUMENTS 3,395,714 8/1968 Kahane et al. .
3,633,589 1/1972 Kahane et al. .
3,640,285 2/1972 Briskin et al. ..... 131/365
3,744,496 7/1973 McCarty et al. .
3,902,504 9/1975 Owens, Jr. et al. .
4,225,636 9/1980 Cline et al. .
4,231,377 11/1980 Cline et al. .
4,407,308 10/1983 Baker et al. .
4,420,002 12/1983 Cline .
4,450,847 5/1984 Owens .
4,461,311 7/1984 Matthews et al. .
4,505,282 3/1985 Cogbill et al. .
4,561,454 12/1985 Guess .
4,607,647 8/1986 Dashley et al. .
4,615,345 10/1986 Durocher .
4,691,717 9/1987 Ikeda et al. .
4,805,644 2/1989 Hampl, Jr. et al. .
4,881,557 11/1989 Martin .
4,915,118 4/1990 Kaufman et al. .
4,924,888 5/1990 Perfetti et al. .

*Primary Examiner*—V. Millin
*Assistant Examiner*—J. Doyle

[57] ABSTRACT

Cigarettes which yield low levels of visible sidestream smoke upon use employ an outer paper wrapping material including magnesium hydroxide, calcium carbonate and flax fibers. The outer wrapping material has an inherent permeability of about 10 CORESTA units. The wrapping material contains an amount of water soluble alkali metal salt sufficient to provide at least about 30 mg water soluble alkali metal ions per gram of dry base web. The alkali metal salt normally is such that the wrapping material includes a significantly greater level of potassium ions than sodium ions. The cigarettes also employ an inner paper wrapping material including carbonaceous material and/or tobacco.

37 Claims, 2 Drawing Sheets

CIGARETTE

BACKGROUND OF THE INVENTION

The present invention relates to smoking articles such as cigarettes, and in particular to cigarettes which generate low amounts of visible sidestream smoke.

Popular smoking articles, such as cigarettes, have a substantially cylindrical rod shaped structure and include a charge of smokable material, such as shredded tobacco (e.g., cut filler), surrounded by a paper wrapper thereby forming a so-called "tobacco rod." It has become desirable to manufacture cigarettes having cylindrical filter elements aligned in an end-to-end relationship with the tobacco rod. Typically, filter elements are manufactured from fibrous materials such as cellulose acetate and plug wrap, and are attached to the tobacco rod using a circumscribing tipping material. It also has become desirable to perforate the tipping material and plug wrap, in order to provide for dilution of drawn mainstream smoke with ambient air.

Cigarettes are employed by the smoker by burning one end thereof. The smoker then receives mainstream smoke into his/her mouth by drawing on the opposite end (e.g., the filter end) of the cigarette. During the time that the cigarette is not being drawn upon by the smoker, it remains burning, and sidestream smoke is generated. Sidestream smoke is smoke which directly enters the atmosphere during the static burn period of a cigarette. Sidestream smoke diffuses into the atmosphere, and the characteristic visible nature thereof may be perceived negatively by certain individuals. Thus, certain cigarette smokers have indicated a desire to decrease the levels of visible sidestream smoke generated by their cigarettes.

Cigarette paper wrappers for the preparation of tobacco rods are set forth in U.S. Pat. No. 4,231,377 to Cline et al, U.S. Pat. No. 4,420,002 to Cline, U.S. Pat. No. 4,461,311 to Mathews et al, U.S. Pat. No. 4,450,847 to Owens, U.S. Pat. No. 4,805,644 to Hampl, Jr. et al, U.S. Pat. No. 4,881,557 to Martin and U.S. Pat. No. 4,915,118 to Kaufman et al. The paper wrappers proposed in the foregoing patents have a propensity to provide cigarettes which generate relatively low levels of visible sidestream smoke. A cigarette which generates relatively low levels of visible sidestream smoke is set forth in U.S. Pat. No. 4,924,888 to Perfetti et al. However, cigarette paper wrappers which are useful for manufacturing cigarettes which generate low amounts of visible sidestream smoke upon use, particularly those wrappers which include magnesium hydroxide as a filler component, often have the propensity to provide, upon use, an ash having flaky properties.

It would be desirable to provide a cigarette which incorporates a paper wrapper such that upon use (i) the cigarette generates low levels of sidestream "tar" and hence low levels of visible sidestream smoke, (ii) the cigarette provides good flavor and smoking satisfaction to the smoker thereof, (iii) the ash of the paper wrapper is fairly cohesive and not highly flaky, and (iv) is capable of sustaining smolder at least under FTC smoking conditions.

SUMMARY OF THE INVENTION

The present invention relates to a cigarette which delivers good tobacco flavor, pleasure and satisfaction while generating relatively low levels of sidestream "tar". Such cigarettes also exhibit extremely low levels of visible sidestream smoke as well as low levels of sidestream odor. Cigarettes of the present invention (i) have a weight which is not overly excessive, (ii) yield an acceptable ash and fire cone, (iii) yield acceptable smolder properties, and (iv) yield a burn rate which is acceptable. Further, such cigarettes have a tendency to (i) burn back uniformly during use, and (ii) not provide visible staining of the outer wrap immediately behind the char line during use.

Cigarettes of the present invention include a charge or roll of smokable material contained in two layers of circumscribing outer wrapping materials to form a so-called "tobacco rod." The tobacco rod is such that a first (i.e., inner) wrapping material circumscribes the smokable material, and a second (i.e., outer) wrapping material circumscribes the first wrapping material. The smokable material is a smokable filler material comprising tobacco cut filler material. Normally, the smokable material is all tobacco cut filler material, which is cased and/or top dressed.

The second or outer layer of wrapping material surrounding the roll of smokable material is a paper wrapper The paper wrapper includes a cellulosic base web and a water insoluble inorganic filler. The preferred cellulosic material is flax fibers, and the preferred inorganic filler is a mixture of calcium carbonate and magnesium hydroxide. The paper wrapper also includes at least one water soluble alkali metal salt. The total amount of water soluble alkali metal salt normally is sufficient to provide at least about 30 mg water soluble alkali metal ions per gram of dry base web. As used herein, the term "water soluble alkali metal ions" in reference to the incorporation of those ions within the paper wrapper means that those ions incorporated into the paper are provided into the paper in the form of water soluble salts. The anions of such salts can be organic (e.g., a malate ion) or inorganic (e.g., a chloride ion) in nature. The alkali metal salt normally is such that the paper wrapper includes a significantly greater level of potassium ions than sodium ions. The paper wrapper also includes at least one organic acid (which can be present in a disassociated and/or non-disassociated form) which is incorporated into the paper wrapper in a non-disassociated form. Optionally, at least one sugar, as well as flavoring agents, can be incorporated into the paper wrapper. Preferred wrapping materials have relatively high basis weights. Also preferred are wrapping papers having fairly low inherent permeabilities, and such papers can be electrostatically perforated so as to have relatively high net permeabilities.

The first or inner wrapping material surrounding the roll of smokable material is a paper wrapper containing a carbonaceous material and/or a tobacco material.

A cigarette of the present invention also includes a filter element positioned adjacent one end of the smokable rod, and tipping material circumscribing tne filter element and an adjacent region of the smokable rod. Cigarettes having low efficiency and moderate efficiency cellulose acetate filter tow items are particularly preferred. The cigarettes preferably are air diluted. Certain cigarettes of the present invention have an acid (e.g., citric acid) incorporated into the filter elements thereof.

Preferred cigarettes of the present invention, when employed, yield low levels of visible sidestream smoke. In particular, cigarettes of the present invention, which incorporate paper wrappers for the smokable rod employing magnesium hydroxide filler, have improved ash properties over similar cigarettes which incorporate similar paper wrappers but having less than about 20 mg of alkali metal ions per gram of dry base web. An improved ash is an ash which is cohesive and exhibits good integrity, and which is not highly flaky. In addition, the paper wrappers of preferred cigarettes of the present invention can provide for sidestream and mainstream smoke which does not possess a significant off-aroma or off-taste.

DETAILED DESCRIPTION OF THE PREFERRED EMBODIMENTS

Figure 1:
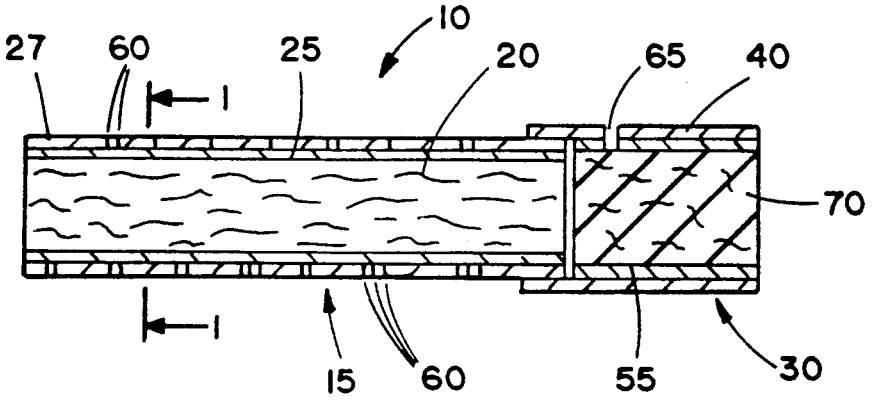
FIG. 1 is a longitudinal sectional view of a cigarette of this invention.

A preferred embodiment of a cigarette of this invention is shown in FIG. 1. The cigarette 10 includes a generally cylindrical rod 15 of smokable material 20, such as tobacco cut filler, contained in a first circumscribing inner wrapping material 25 and a second or outer wrapping material 27 circumscribing the first wrapping material. The first and second circumscribing wrapping materials directly contact one another (i.e., the inner surface of the outer wrapping material contacts the outer surface of the inner wrapping material). As such, the outer wrapping material overwraps the inner wrapping material. The rod 15 is hereinafter referred to as a "tobacco rod." The ends of the tobacco rod 15 are open to expose the smokable material. The cigarette 10 also includes a filter element 30 positioned adjacent one end of the tobacco rod 15 such that the filter element and tobacco rod are axially aligned in an end-to-end relationship, preferably abutting one another. Filter element 30 has a generally cylindrical shape, and the diameter thereof is essentially equal to the diameter of the tobacco rod. The ends of the filter element are open to permit the passage of air and smoke therethrough.

Figure 2:
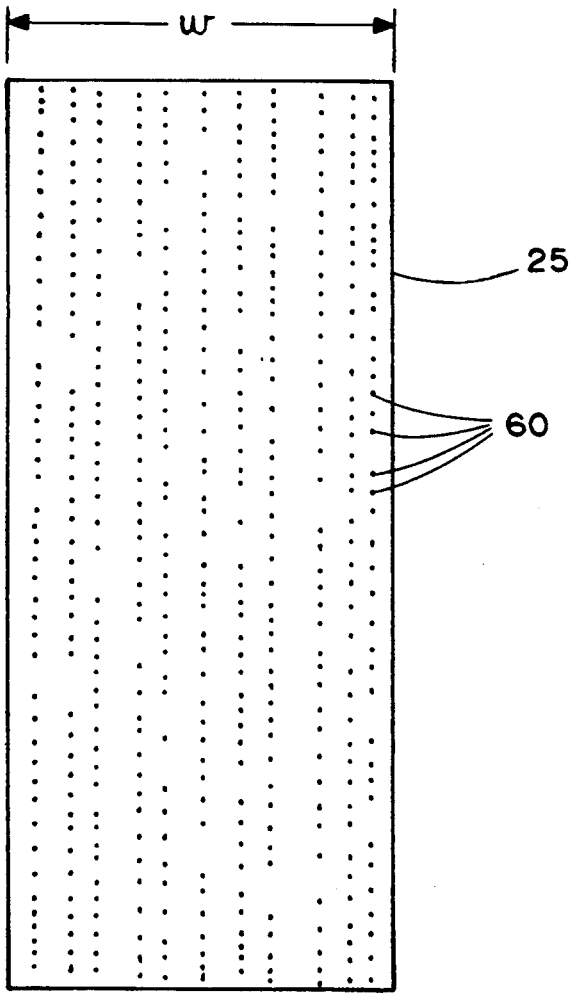
FIG. 2 is a diagrammatic illustration of the type of wrapping material which can be employed to provide the smokable rod of a cigarette of the present invention.

Referring to FIGS. 1 and 2, the wrapping material 25 has a width w (shown in FIG. 2) which is equal to the circumference of the cigarette plus the lap zone of the glue line which ultimately results during cigarette manufacture. The preferred wrapping material 25 includes a series of perforations 60 which extend in a linear fashion along the longitudinal length of thereof. Alternatively, other configurations, such as a random perforation pattern, can be provided. The size, number and relative positioning of the individual perforations 60 can vary depending upon the desired characteristics of the cigarette which has the wrapping material incorporated therein. The individual perforations are shown as enlarged in FIGS. 1 and 2.

Figure 1A:
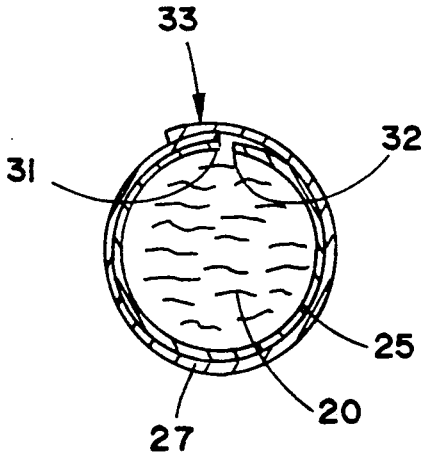
FIGS. 1A and 1B are cross-sectional radial views of the cigarette shown in FIG. 1 taken along lines 1—1 in FIG. 1.

Referring to FIG. 1A, smokable material 20 is contained in a first circumscribing inner wrapping material 25, and a second outer wrapping material 27 circumscribes the first wrapping material. The first wrapping material 25 is formed into a circular shape such that the ends 31, 32 of the sides thereof abut one another. The ends 31, 32 of wrapping material 25 can abut one another (as shown in FIG. 1A), nearly abut one another, or slightly overlap one another. The second wrapping material 27 includes a lap zone 33 including a suitable adhesive therebetween so as to form a secure outer wrapper. As such, the width of the inner wrapping material is less than that of the outer wrapping material. A cigarette rod having such a configuration can be provided by supplying paper wrappers from two bobbins on a suitably equipped cigarette making machine, positioning the inner wrapping material on top of the outer wrapping material, passing the two wrapping materials so positioned through the garniture region of the cigarette making machine, and forming the tobacco rod. A preferred apparatus for manufacturing a cigarette is described in U.S. patent application commonly assigned Ser. No. 07/609,618, filed Nov. 6, 1990, in the name of Holmes, Marritt and Nelson. Such an apparatus includes a garniture region including a movable belt which travels along a predetermined path; a bobbin for supplying the outer wrapping material onto the movable belt of the garniture so as to travel along the path of the movable belt; and another bobbin for supplying the inner wrapping material onto the outer wrapping material on the movable belt so as to travel along the path of the movable belt. The other bobbin supplies the inner wrapping material using a turner assembly including a movable base; a first bar for receiving that wrapping material from the bobbin and for changing the path of that wrapping material along a path substantially perpendicular to the path of the movable belt; and a second bar for receiving that wrapping material from the first bar and for changing the path of the wrapping material to a direction substantially parallel to the outer wrapping material so as to place the inner wrapping material onto the first while on the movable belt.

Figure 1B:
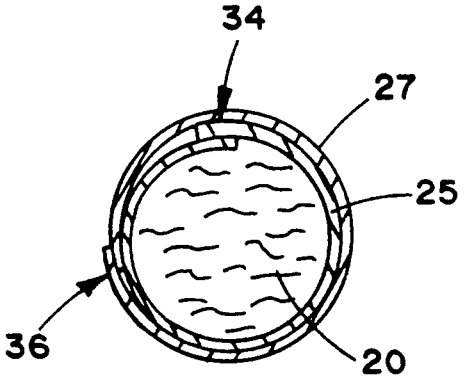

Referring to FIG. 1B, smokable material 20 is contained in a first circumscribing inner wrapping material 25, and a second outer wrapping material 27 circumscribes the first wrapping material. The first wrapping material 25 is formed into a circular shape such that a lap zone 34 including a suitable adhesive therebetween is formed. The second wrapping material includes a lap zone 36 including a suitable adhesive therebetween so as to form a secure outer wrapper. A cigarette rod having such a configuration can be provided by forming a cigarette rod using known techniques, and then wrapping the rod so formed with an outer wrapping material. Equipment for providing a cigarette in such a manner will be apparent to the skilled artisan.

Typically, the tobacco rod has a length which ranges from about 50 mm to about 85 mm, and a circumference of about 16 mm to about 28 mm. The tobacco rods and the resulting cigarettes can be manufactured in any known configuration using known cigarette making techniques and equipment.

Typically, the filter element has a length which ranges from about 20 mm to about 35 mm and a circumference of about 16 mm to about 28 mm. The filter material can be any suitable material such as cellulose acetate, polypropylene, tobacco material, or the like. Examples of suitable filter materials are cellulose acetate tow items having (i) about 2.7 denier per filament and about 39,000 total denier, and (ii) about 3 denier per filament and about 35,000 total denier. Such tow items can be plasticized with triacetin as is common for many commercially available cigarettes. Such tow items conveniently provide filter elements exhibiting a removal efficiency of particulate matter from mainstream smoke of greater than about 40 weight percent. The plug wrap typically is a conventional paper plug wrap, and can be either air permeable or essentially air impermeable. However, if desired, a nonwrapped cellulose acetate filter element can be employed. Filter elements having two or more segments, and which are provided using known plug-tube-combining techniques, also can be employed. Exemplary filter elements are described in U.S. patent application Ser. No. 567,519, filed Aug. 15, 1990. The various filter elements suitable for use in this invention can be manufactured using known cigarette filter making techniques and equipment.

Certain filter elements can provide minimal mainstream smoke removal efficiencies while maintaining the desirable draw characteristics of the cigarette. Such minimal smoke removal efficiencies are provided by the so-called "low efficiency" filters. Low efficiency filters have a minimal ability to remove mainstream smoke particulates. Generally, low efficiency filters provide about 40 weight percent mainstream smoke particulate removal efficiency or less. The low efficiency filter can be used in order that the relatively low "tar" yield is obtained primarily as a result of a relatively high level of filter ventilation or air dilution. Such cigarette configurations provide a means for reducing the yields of mainstream gaseous components. An example of a suitable material for providing a low efficiency filter element is a cellulose acetate tow item having about 8 denier per filament and about 40,000 total denier.

Certain filter elements incorporate acid, such as organic acid, therein. The acid can be incorporated into the filter material of the filter element when the filter material is manufactured or applied to the filter material after its manufacture. Preferably, the acid is incorporated fairly uniformly within the filter material. Examples of suitable organic acids include malic, citric, levulinic, fumaric, oxalic and tartaric acids, as well as blends thereof. Typically, sufficient acid is incorporated into the filter element to provide a filter material having greater than about 2.5 percent, preferably greater than about 4.5 percent of that acid, based on the weight of the filter material. Typically, the amount of acid incorporated into the filter element is such that less than about 20 percent, frequently less than about 10 percent of the filter material is acid, based on the weight of the filter material. Two or more filter segments composed of different filter materials (e.g., tow items), incorporating different organic acids and/or incorporating different levels of organic acid can be combined (e.g., using plug tube combining techniques) to form the filter element.

The filler material employed in the manufacture of the smokable rod can vary. The preferred filler material is an "American blend" of tobacco materials. For example, the filler can include a blend of flue-cured, Burley, Maryland, Oriental, reconstituted and volume expanded tobaccos. Other suitable blends are described in U.S. Pat. No. 4,924,888 to Perfetti et al.

The smokable materials generally are employed in the form of cut filler as is common in conventional cigarette manufacture. For example, the smokable filler material can be employed in the form of shreds or strands cut into widths ranging from about 1/20 inch to about 1/60 inch, preferably from about 1/25 inch to about 1/35 inch. Generally, such pieces have lengths which range from about 0.25 inch to about 3 inches.

As used herein, "packing density" means the weight of the filler material which occupies a unit volume within the smokable rod. For articles of this invention, the packing density generally ranges from about 100 $mg/cm^3$ to about 300 $mg/cm^3$, more typically from about 150 $mg/cm^3$ to about 275 $mg/cm^3$.

Flavorants can be incorporated into the cigarettes. For example, the filler materials can be employed with casing or top dressing additives. See, for example, Leffingwell et al, *Tobacco Flavoring for Smoking Products* (1972). Flavorants such as menthol can be incorporated into the cigarette using techniques familiar to the skilled artisan. If desired, flavor additives such as organic acids can be incorporated into the cigarette as additives to the cut filler. See, U.S. Pat. No. 4,830,028 to Lawson et al.

Typically, the tipping material circumscribes the filter element and an adjacent region of the tobacco rod such that the tipping material extends about 3 mm to about 6 mm along the length of the tobacco rod. Typically, the tipping material is a conventional paper tipping material. The tipping material can have a porosity which can vary. For example, the tipping material can be essentially air impermeable, air permeable, or be treated (e.g., by mechanical or laser perforation techniques) so as to have a region of perforations, openings or vents thereby providing a means for providing air dilution to the cigarette. The total surface area of the perforations and the positioning of the perforations along the periphery of the cigarette can be varied in order to control the performance characteristics of the cigarette.

For certain cigarettes of the present invention, the air dilution means can be positioned along the length of the cigarette at a point along the filter which is at a maximum distance from the extreme mouthend thereof. The maximum distance is dictated by factors such as manufacturing constraints associated with the type of tipping employed and the cigarette manufacturing apparatus and process. For example, for a filter element having a 27 mm length, the maximum distance may range from about 23 mm to about 26 mm from the extreme mouthend of the filter element. The positioning of the air dilution vents a maximum distance from the extreme mouthend of certain cigarettes allows for providing a maximum ventilation level for a given "tar" yield and maximum cigarette pressure drop for a given filter element and tobacco rod combination.

As used herein, the term "air dilution" is the ratio (generally expressed as a percentage) of the volume of air drawn through the air dilution means to the total volume of air and smoke drawn through the cigarette and exiting the extreme mouthend portion of the cigarette. For air diluted or ventilated cigarettes of the present invention, the amount of air dilution can vary. Generally, the amount of air dilution for a cigarette is greater than about 10 percent, often greater than about 20 percent, and frequently greater than about 30 percent. Typically, for cigarettes of relatively small circumference (i.e., about 21 mm or less) the air dilution can be somewhat less than that of cigarettes of larger circumference. The upper limit of air dilution for a cigarette typically is less than about 75 percent, more frequently less than about 70 percent.

As used herein, the term "pressure drop" in referring to the cigarette is meant that difference between atmospheric pressure at the extreme mouthend point of the cigarette, as measured at a given flow rate through the cigarette. Typical pressure drop values for cigarettes of the present invention are greater than about 50 mm, more frequently greater than about 80 mm of water pressure drop at 17.5 ml/sec of air flow rate.

The preferred outer wrapping materials for the tobacco rod have relatively high basis weights. Typical basis weights for such wrapping materials are at least about 30 g/m$^2$, often are greater than about 40 g/m$^2$, and frequently are greater than about 45 g/m$^2$. Typical basis weights do not exceed about 80 g/m$^2$.

Most desirable outer wrapping materials for the tobacco rod have relatively low inherent permeabilities, and certain wrapping materials have relatively high net permeabilities. By the term "inherent permeability" is meant the air flow porosity of the wrapping material itself. Typically, wrapping materials have inherent permeabilities which are less than about 30 CORESTA units, preferably less than about 25 CORESTA units, more preferably about 20 CORESTA units or less, and often about 10 CORESTA units or less. By the term "net permeability" is meant the air flow porosity of the wrapping material as used in manufacturing the tobacco rod. Typically, the air permeability is provided to the wrapping material using micro laser, mechanical or electrostatic perforation techniques. During micro laser and electrostatic perforation operations, it is most desirable that care be taken to maintain the desired color and opacity of the paper. For example, it is most desirable to minimize or avoid an unsightly "browning" or singeing of the paper.

The outer wrapping materials preferably are processed in order to have relatively high net permeabilities (e.g., net permeabilities above about 50 CORESTA units). For example, wrapping materials having low inherent permeabilities can be perforated using conventional electrostatic perforating techniques (e.g., to provide individual perforations comparable in size to conventional electrostatically provided perforations) to obtain a wrapping material having a porosity of from about 50 to about 225 CORESTA units, preferably from about 80 to about 180 CORESTA units, more preferably from about 90 to about 120 CORESTA units.

The sizes of the individual perforations which provide for the high net permeabilities to the cigarette paper wrap generally are such that the perforations are larger than the pores which are present in the naturally occurring paper wrap (i.e., which provide the inherent permeability to the paper). For aesthetic purposes, the individual perforations preferably are small enough to not be unsightly. For example, the perforations are not particularly noticeable, and in most instances are barely visible to the naked eye.

Typical outer wrapping materials are paper wrapping materials which contain about 50 to about 75, preferably about 55 to about 70 weight percent cellulosic material; and about 25 to about 50, preferably about 30 to about 45 weight percent inorganic filler. Often, desirable paper wrapping materials contain more than about 5, and frequently more than about 7 percent by weight of magnesium hydroxide filler. Preferred paper wrapping materials contain from about 8 to about 35 percent, more often about 20 to about 30 percent, by weight of magnesium hydroxide. Examples of suitable materials are described in U.S. Pat. No. ∝,450,847 to Owens, U.S. Pat. No. 4,881,557 to Martin and U.S. Pat. No. 4,915,118 to Kaufman et al. The preferred wrapping materials also contain other inorganic fillers, such as calcium carbonate. Preferred paper wrapping materials contain about 5 to about 35 percent, more often about 10 to about 20 percent, by weight of calcium carbonate. The preferred papers also contain flax fibers, wood pulp, or other cellulosic material to provide a cellulosic base web.

The outer wrapping material includes at least one water soluble alkali metal salt. Examples of water soluble alkali metal salts include potassium malate, potassium acetate, potassium nitrate, potassium citrate, potassium chloride, potassium succinate, potassium propionate, potassium formate, and the like, as well as mixtures thereof. It is preferable that at least a portion of the alkali metal be provided in the form of a salt exhibiting a very low hygroscopic character. An example of such a salt is potassium chloride.

The manner in which the water soluble alkali metal salt is incorporated into the outer paper wrapping material can vary. The salt can be incorporated into the paper during the manufacturing process. Alternatively, the salt can be incorporated into the paper using size press techniques, printing techniques, painting techniques, or the like. Such techniques will be apparent to the skilled artisan. It is highly preferred that the salt be incorporated into the paper in an essentially uniform manner throughout the paper. The various water soluble salts can be incorporated into the paper simultaneously, or at different processing stages during or after paper manufacture.

The amount of water soluble alkali metal salt incorporated into the outer paper wrap is such that the amount of that salt provides at least about 30 mg water soluble alkali metal ions per gram of dry base web. The amount of water soluble alkali metal salts incorporated into the paper wrap normally is such that those salts provide at least about 35 mg, and frequently at least about 40 mg, water soluble alkali metal ions per gram of dry base web. The amount of water soluble alkali metal salts incorporated into the paper wrap normally is such that those salts provide less than about 90 mg, and frequently less than about 80 mg, water soluble alkali metal ions per gram of dry base web.

The level of potassium ions within the outer paper wrapping material normally is significantly greater than the level of sodium ions within the paper. In particular, the weight ratio of potassium ions to sodium ions within the paper is greater than about 100:1, preferably greater than about 150:1, more preferably greater than about 200:1.

The outer paper wrapping material has at least one organic acid applied thereto in a non-disassociated form. The organic acid normally is applied to finished paper using size press or printing techniques. Examples of organic acids include malic, citric, levulinic, fumaric, oxalic and tartaric acids, as well as blends thereof. It is often preferable to apply the acid to the finished paper by dissolving or dispersing the acid in alcohol or water, and applying the resulting solution or dispersion to the paper. Typically, sufficient organic acid is applied to the paper to provide a paper having greater than about 0.2 percent, preferably greater than about 0.3 percent, more preferably greater than about 0.4 percent of that organic acid, based on the dry weight of that paper. Typically, the amount of organic acid applied to the paper is less than about 6 percent, usually less than about 4 percent, based on the dry weight of that paper. Although the organic acid is applied to the paper in a non-disassociated (i.e., acid) form, a certain amount of the organic acid can be present within the paper in a disassociated (i.e., salt) form. As used herein and only for purposes of the present invention, the term "non-disassociated" in referring to the organic acid is meant that the acid is not in a form of a salt (e.g., a sodium, potassium, calcium or magnesium salt).

The organic acid can be incorporated into the outer paper wrapping material together with the alkali metal salt. For example, potassium hydroxide can be contacted with a stoichiometric excess of malic acid in water, and the resulting solution of potassium malate and malic acid can be applied to the wrapping material using a size press.

The outer paper wrapping material optionally can have at least one sugar applied thereto. Examples of sugars include sucrose, glucose, fructose, dextrose and maltose. The sugar normally is applied to the finished paper using size press or printing techniques. It is often preferable to apply the sugar to the finished paper by dissolving the sugar in an aqueous liquid (e.g., along with the previously described alkali metal salt), and applying the resulting solution to the paper. When employed, the sugar is applied to the paper in an amount up to about 12 percent, preferably about 0.5 to about 8 percent, more preferably about 1 to 5 percent, based on the dry weight of the paper.

If desired, flavoring agents and/or flavor and aroma precursors (e.g., ethyl vanillin glucoside) can be incorporated into the outer paper wrapping material. See, U.S. Pat. No. 4,941,486 to Dube et al, which is incorporated herein by reference.

Preferred outer paper wrapping materials incorporate at least about 0.4, more preferably greater than about 1, and most preferably greater than about 2 weight percent malate ion (e.g., provided as potassium malate and malic acid).

Examples of suitable outer paper wrapping materials are available as Ecusta Experimental Paper Nos. TOD 05504, TOD 5551, TOD 05560, TOD 5581 and TOD 05505 from Ecusta Corp.

The first or inner wrapping material 25 comprises carbonaceous material (i.e., a material consisting primarily of carbon) and a cellulosic (e.g., base web) material. The cellulosic material of the inner wrapping material can vary. Typical cellulosic materials include tobacco parts (e.g., ground tobacco stems), wood pulp, flax fibers, and the like, as well as combinations thereof. If desired, a certain amount of inorganic filler material (e.g., calcium carbonate) can be incorporated into the paper along with the cellulosic and carbonaceous materials. The amount of carbonaceous material within the wrapping material can vary. Typical paper inner wrapping materials have relatively high levels of carbonaceous material and/or incorporate carbonaceous materials formed under relatively high pyrolysis temperatures when outer wrapping materials are of relatively low porosity. Normally, the amount of the carbonaceous material within the inner wrapping material is greater than about 10 percent, often greater than about 20 percent, and frequently greater than about 30 percent, based on the weight thereof. The form of the carbonaceous material can vary; but is typically in powder or particulate form of about 5 microns to about 20 microns in diameter.

The permeability of the inner wrapping material can vary, but typically is higher than the permeability of the outer wrapping material, and frequently is quite high relative to the outer wrapping material. Normally, the ultimate permeability provided by the combined wrapping materials is slightly less than that permeability of the outer wrapping material; however, effects of the inner wrapping material towards lowering the ultimate permeability of the combined wrapping materials are less in instances in which the differences between the permeabilities of the inner and outer wrapping materials are relatively great. As such, the net permeability provided by both of the wrapping materials approaches about ½ of the permeability exhibited by the wrapping material having the lesser permeability. Generally, the permeability of the inner wrapping material is above about 20 CORESTA units, frequently above about 40 CORESTA units, and often is above about 100 CORESTA units.

Various inner wrapping materials can be employed. One wrapping material is available as P-2540-94-A from Kimberly-Clark Corp.; which is a paper containing about 29 weight percent particles of activated charcoal provided from coconut hulls and about 71 weight percent tobacco parts, and having a permeability of about 250 CORESTA units. Another wrapping material is available as P-2540-94-C from Kimberly-Clark Corp.; which is a paper containing about 40 weight percent particles of activated charcoal provided from coconut hulls and about 60 weight percent tobacco parts, and having a permeability of about 350 CORESTA units. Another wrapping material is available as P-2269-82 from Kimberly-Clark Corp.; which is a paper containing about 9 weight percent particles of activated charcoal from coconut hulls and about 91 weight percent wood pulp, and having a permeability of about 12 CORESTA units. Another wrapping material is available as P-1224-67 from Kimberly-Clark Corp.; which is a paper containing about 9 weight percent particles of activated charcoal provided from coconut hulls and about 91 weight percent wood pulp, and having a permeability of about 559 CORESTA units. Another wrapping material is available as P-2540-94-D from Kimberly-Clark Corp.; which is a paper containing about 50 weight percent particles of activated charcoal provided from coconut hulls and about 50 weight percent tobacco parts, and having a permeability of about 380 CORESTA units. Another wrapping material is available as P-2540-107-A from Kimberly-Clark Corp., and contains about 31 weight percent carbonaceous material and exhibits a basis weight of about 47 g/m$^2$. Another wrapping material is available as P-2540-107-B from Kimberly-Clark Corp., and contains about 40 weight percent carbonaceous material and exhibits a basis weight of about 54 g/m$^2$. Another wrapping material is available as P-2540-107-C from Kimberly-Clark Corp., and contains about 51.5 weight percent carbonaceous material and exhibits a basis weight of about 66 g/m$^2$. Another wrapping material is available as P-2540-107-D from Kimberly-Clark Corp., and contains about 51 weight percent carbonaceous material and exhibits a basis weight of about 65 g/m$^2$. Other suitable wrapping materials are available as P-2540-94-A, P-144-KC-G, P-144-RB, P144-KCL, P144-SN20, P-2882-28, P-2540-136E, P-2540-136C, P-2540-136D, and P144-BHC from Kimberly-Clark Corp.

Certain flavoring agents can be incorporated into or otherwise carried by the inner wrapping material. In particular, the carbonaceous material of the inner wrapping material can act as a substrate for certain flavoring agents. Examples of suitable flavoring agents include menthol, vanillin, and the like. Suitable flavoring agents are set forth in Leffingwell et al, *Tobacco Flavoring For Smoking Products* (1972). The carbonaceous material is a particularly good substrate for volatile flavoring agents, such as menthol. The inner wrapping material also can carry certain forms of tobacco, such as tobacco extracts, essences and aroma oils, as well as finely divided tobacco particles and tobacco dust.

The carbonaceous material of the inner wrap can vary. The carbonaceous material is combustible under those conditions (i.e., temperatures) experienced during the period that the cigarette is smoked. The carbonaceous material most preferably is derived from natural cellulosic materials. Certain natural cellulosic materials have a high cellulose content (i.e., a cellulose content above about 80 weight percent), and often a high alpha-cellulose content (i.e., an alpha-cellulose content above about 80 weight percent). Examples of natural cellulosic materials which can be pyrolyzed to provide combustible carbonaceous materials include tobacco materials, softwood pulp, hardwood pulp, coconut hulls, kapok fibers, cotton fibers, cotton linters, and the like, as well as combinations thereof. Combustible carbonaceous materials typically are provided by pyrolyzing a natural cellulosic material under inert (e.g., nitrogen) atmosphere at temperatures between about 600° C. and about 1,200° C., preferably between about 650° C. and about 850° C. Preferred carbonaceous materials include at least about 80 weight percent carbon, normally include about 85 weight percent and about 95 weight percent carbon. Exemplary carbonaceous materials are set forth in European Patent Application No. 236,992; U.S. patent application Ser. No. 378,551, filed Jul. 11, 1989, now U.S. Pat. No. 4,991,596; and U.S. patent application Ser. No. 414,833, filed Sep. 29, 1989, now U.S. Pat. No. 5,074,321.

The amount of carbonaceous material within the inner wrapping material relative to the total weight of the tobacco rod can vary. Typically, the inner wrap comprises greater than about 2, often about 2 to about 8, and frequently about 3 to about 7 percent carbonaceous material therewithin, based on the total weight of the tobacco rod.

Other suitable inner wrapping materials are tobacco containing papers. Tobacco containing papers are made from tobacco parts (e.g., tobacco stems, tobacco fines and/or tobacco extracts), and also can have cellulosic materials (e.g., wood pulp) and inorganic fillers (e.g., calcium carbonate and/or magnesium hydroxide) therein. Exemplary tobacco papers available as P-2674-157-A5116, P-2831-130, P-2831-22-1, P-2831-23-3, P-1976-25-1, P-1976-25-2 and P-1976-25-3 from Kimberly-Clark Corp. Preferred inner wrapping materials typically include about 65 to about 85 weight parts tobacco and about 15 to about 35 weight parts softwood pulp. Such tobacco papers can have high or low air permeability, high or low levels of burn chemical (e.g., potassium succinate or potassium citrate), and can be electrostatically perforated, if desired.

Cigarettes of this invention generally provide FTC "tar" yields in the range from about 2 to about 14 mg/cigarette. Typical FTC "tar" to FTC carbon monoxide ratios are less than about 1.8.

Cigarettes of the present invention exhibit a desirably high resistance to draw. For example, cigarettes of this invention exhibit a pressure drop of between about 50 and about 200 mm water pressure drop at 17.5 cc/sec. air flow. Typically, pressure drop values of cigarettes are measured using a Filtrona Filter Test Station (CTS Series) available from Filtrona Instruments and Automation Ltd. Cigarettes of this invention preferably exhibit resistance to draw values of about 70 to about 180, more preferably about 80 to about 150 mm water pressure drop at 17.5 cc/sec. air flow.

Cigarettes of the present invention, when smoked, generally yield less than about 20 mg, preferably less than about 10 mg of sidestream "tar" per cigarette, as determined using the apparatus and techniques described by Proctor et al, *Analyst*, Vol. 113, p. 1509 (1988). Such cigarettes normally provide more than about 6 puffs, preferably more than about 8 puffs per cigarette when smoked under FTC conditions. FTC conditions consist of 35 ml puffs of 2 second duration separated by 58 seconds of smolder. Normally, cigarettes of the present invention provide less than about 15 puffs, and often less than about 12 puffs, when smoked under FTC conditions. Normally, cigarettes of the present invention yield less than about 2 mg, preferably less than about 1.5 mg, and most preferably less than about 1 mg of sidestream "tar" per 1 minute puff cycle period, when smoked under FTC conditions.

Cigarettes of the present invention, when smoked, yield ash and firecone which are acceptable. The ash is not overly dark in color, is not easily dislodged from the cigarette, and is not flaky. The firecone is of acceptable length, is not overly cohesive, and is not overly fragile (i.e., maintains its integrity).

Cigarettes of the present invention maintain smolder under static burning conditions (i.e., without puffing after the lighting puff). Much preferred cigarettes maintain smolder for at least about 3 minutes, more preferably at least about 5 minutes, and often at least about 7 minutes, without self-extinguishing. Preferred cigarettes are such that at least about one third of the burnable length of the tobacco rod, often at least about one half of the burnable length of the tobacco rod, and frequently the total burnable length of the tobacco rod is consumed during static burning conditions without self-extinguishing.

Cigarettes of the present invention burn at an acceptable rate during smoking, particularly under free smolder (i.e., static burning) conditions. Typical cigarettes of the present invention, and particularly those cigarettes having a circumference of about 24 mm to about 25 mm, exhibit a static burn rate of less than about 5 mm/min., and frequently between about 1.5 mm/min. and about 4 mm/min.

The following examples are provided in order to further illustrate the invention but should not be construed as limiting the scope thereof. Unless otherwise noted, all parts and percentages are by weight.

EXAMPLE 1

Cigarettes substantially as shown in FIG. 1 are prepared as follows:

The cigarettes each have a length of about 84 mm and a circumference of about 24.8 mm, and include a tobacco rod having a length of 57 mm and a filter element having a length of about 27 mm. Each filter element includes cellulose acetate tow circumscribed by nonporous paper plug wrap. Each filter element is attached to each tobacco rod using nonporous tipping paper. For each cigarette, the tipping paper circumscribes the filter element and about a 4 mm length of the tobacco rod in the region adjacent the filter element. The filter elements are not ventilated. The filler material employed in providing the tobacco rod is in the form of strands cut at about 25 cuts per inch. The filler material includes a blend of about 29 percent flue-cured tobacco, about 14 percent of a mixture of volume expanded flue-cured and Burley tobacco cut filler, about 25 percent reconstituted tobacco material, about 17 percent Oriental tobaccos, and about 15 percent Burley tobacco.

The first or inner cigarette paper wrap is available as P-2540-136E from Kimberly-Clark Corp. The paper wrap contains about 25 percent softwood pulp, about 25 percent tobacco parts and about 50 percent non-activated charcoal particles from wood pulp char. The paper is black in color, has a somewhat rough surface texture, and exhibits a permeability of about 20 CORESTA units.

The tobacco is such that the inner wrap circumscribes the smokable blend and the outer wrap circumscribes the inner wrap. The inner and outer wraps directly contact one another (i.e., the inner surface of the outer wrap contacts the outer surface of the inner wrap.

The outer paper wrap is available as Ecusta Experimental No. TOD 05504 from Ecusta Corp. The paper wrap is a heavy weight sheet, low visible sidestream paper. The base sheet contains about 15 percent calcium carbonate, about 25 percent magnesium hydroxide and about 60 percent flax fiber. The paper has an inherent permeability of about 10 CORESTA units and a basis weight of about 48 g/m$^2$. The paper has an aqueous solution including malic acid, potassium chloride incorporated therein using a size press. The paper includes about 45 mg potassium ions per gram of dry base sheet and about 1.3 percent malate ion analyzed in the paper (i.e., added to the paper as malic acid). The level of potassium ions in the paper is significantly greater than the level of sodium ions in the paper. The paper is electrostatically perforated so as to yield a net porosity of about 110 CORESTA units.

The filter element is manufactured using conventional cigarette filter making technology from a moderate efficiency cellulose acetate tow item 3.3 denier per filament, 35,000 total denier) and circumscribing air impermeable paper plug wrap.

The tobacco rod and filter element have similar circumferences, are aligned in an abutting, end-to-end relationship, and are secured together using tipping paper. The tipping paper is adhesively secured to the filter element and the adjacent portion of the tobacco rod. The tipping material circumscribes the length of the filter element and about 4 mm of the length of the tobacco rod. Cigarettes so described are manufactured using a Hauni Protos Cigarette Maker from Hauni-Werke Korber & Co. KG. A ring of laser perforations, thus providing air permeability, extends around the periphery of the cigarette about 13 mm from the extreme mouthend thereof. The perforations so provided yield cigarettes with about 30 to about 60 percent air dilution.

The cigarette weighs about 0.98 g and the filler material within the rod has a packing density of about 240 mg/cm$^3$.

The cigarette is smoked by burning the tobacco rod such that the tobacco cut filler burns to yield smoke. The cigarette delivers a rich tobacco flavor as well as an acceptable draft resistance. The mainstream smoke is not harsh and the cigarette yields desirable smoking satisfaction. The mainstream smoke of the cigarette provides a less drying aftertaste than a comparable cigarette provided using a comparable paper wrapper not treated with malic acid. Also, the cigarette yields low amounts of visible sidestream smoke. The cigarette yields an ash having good integrity.

EXAMPLE 2

A cigarette is provided as described in Example 1, except that the outer wrapping material is available as TOD 05560 from Ecusta Corp. and the inner wrapping material is available as P-2540-136E from Kimberly-Clark Corp.

EXAMPLE 3

A cigarette is provided as described in Example 1, except that the inner wrapping material is a tobacco and wood pulp paper available as P-1976-25-1 from Kimberly-Clark Corp.

EXAMPLE 4

A cigarette is provided as described in Example 1, except that the outer wrapping material is available as TOD 05551 from Ecusta Corp. and the inner wrap is available as P-2540-136E from Kimberly-Clark Corp.

EXAMPLE 5

A cigarette is provided as described in Example 1, except that the outer wrapping material is available as TOD 05505 from Ecusta Corp. and the inner wrap is available as P-2540-136E from Kimberly-Clark Corp.

EXAMPLE 6

The cigarette is provided as described in Example 3, except that the inner wrapping material is available as P-1976-25-2 from Kimberly-Clark Corp.

EXAMPLE 7

The cigarette is provided as described in Example 3, except that the inner wrapping material is available as P-1976-25-3 from Kimberly-Clark Corp.

EXAMPLE 8

The cigarette is provided as described in Example 1, except that the outer wrapping material is available as TOD 5551 from Ecusta Corp. and the inner wrapping material is available as P-2831-130 from Kimberly-Clark Corp.

EXAMPLE 9

The cigarette is provided as described in Example 8, except that the inner wrapping material is available as P-2674-157-A5116 from Kimberly-Clark Corp.

What is claimed is:

1. A cigarette comprising a smokable rod including smokable material contained in first and second outer wrapping materials; the first wrapping material circumscribing the smokable material and the second wrapping material circumscribing and overwrapping the first wrapping material;

(a) the first wrapping material including tobacco and/or carbonaceous material;

(b) the second wrapping material (i) having a cellulosic base web containing inorganic filler including magnesium hydroxide, (ii) having a basis weight of greater than about 30 g/m$^2$, (iii) having an acid in a disassociated and/or non-disassociated form which has been incorporated into the paper in non-disassociated form, and (iv) including water soluble alkali metal salt in an amount greater than about 30 mg alkali metal ions per gram of dry base web;

(c) a filter element positioned adjacent one end of the tobacco rod; and (d) tipping material circumscribing the filter element and an adjacent region of the tobacco rod.

2. The cigarette of claim 1 wherein the amount of water soluble alkali metal salt provides to the second wrapping material at least about 35 mg water soluble alkali metal ions per gram of dry base web.

3. The cigarette of claim 1 or 2 Wherein the amount of water soluble alkali metal salt provides to the second wrapping material less than about 90 mg water soluble alkali metal ions per gram of dry base web.

4. The cigarette of claim 1 wherein the water insoluble inorganic filler of the second wrapping material includes calcium carbonate.

5. The cigarette of claim 1 wherein the water insoluble inorganic filler of the second wrapping material includes greater than about 5 weight percent magnesium hydroxide.

6. The cigarette of claim 4 wherein the water insoluble inorganic filler of the second wrapping material includes greater than about 5 weight percent magnesium hydroxide, and the second wrapping material has an inherent permeability of about 20 CORESTA units or less.

7. The cigarette of claim 1 wherein the cigarette further includes air dilution means such that the cigarette is ventilated at least about 20 percent.

8. The cigarette of claim 1 wherein the basis weight of the second wrapping material is greater than about 45 $g/m^2$.

9. The cigarette of claim 1 wherein the organic acid is malic acid.

10. The cigarette of claim 1 wherein the alkali metal salt is potassium chloride.

11. The cigarette of claim 1 wherein the second wrapping material includes at least 1 weight percent malate ion.

12. The cigarette of claim 1 wherein the first wrapping material includes tobacco and wood pulp.

13. The cigarette of claim 1 wherein the first wrapping material includes carbonaceous material and tobacco.

14. The cigarette of claim 1 wherein the alkali metal salt includes potassium malate.

15. The cigarette of claim 1 wherein the second wrapping material includes a flavoring additive.

16. The cigarette of claim 1 wherein the organic acid in a disassociated and/or non-disassociated form which has been incorporated into the paper in non-disassociated form is malic acid.

17. The cigarette of claim 1 wherein the water soluble alkali metal salt is potassium chloride and/or potassium malate.

18. The cigarette of claims 1 or 12 wherein the first wrapping material includes an inorganic filler.

19. The cigarette of claim 18 wherein the inorganic filler calcium carbonate.

20. The cigarette of claim 1 wherein the second wrapping material includes from about 25 to about 50 weight percent inorganic filler.

21. The cigarette of claims 1 or 7 wherein the cigarette has an air dilution of from about 30 percent to about 70 percent.

22. A cigarette comprising a smokable rod including smokable material contained in first and second outer wrapping materials; the first wrapping material circumscribing the smokable material and the second wrapping material circumscribing and overwrapping the first wrapping material;

(a) the first wrapping material including tobacco material;

(b) the second wrapping material (i) having a cellulosic base web containing inorganic filler including magnesium hydroxide, (ii) having a basis weight of greater than about 30 $g/m^2$, (iii) having greater than about 0.2 percent, based on the dry weight of the wrapping material organic acid in a non-disassociated form, and (iv) including water soluble alkali metal salt in an amount greater than about 30 mg alkali metal ions per gram of dry base web;

(c) a filler element positioned adjacent one end of the tobacco rod; and (d) tipping material circumscribing the filter element and an adjacent region of the tobacco rod.

23. The cigarette of claim 22 wherein the amount of water soluble alkali metal salt provides to the second wrapping material at least about 35 mg water soluble alkali metal ions per gram of dry base web.

24. The cigarette of claim 22 or 23 wherein the amount of water soluble alkali metal salt provides to the second wrapping material less than about 90 mg water soluble alkali metal ions per gram of dry base web.

25. The cigarette of claim 22 wherein the water insoluble inorganic filler of the second wrapping material includes calcium carbonate.

26. The cigarette of claim 22 wherein the water insoluble inorganic filler of the second wrapping material includes greater than about 5 weight percent magnesium hydroxide.

27. The cigarette of claim 22 wherein the water insoluble inorganic filler of the second wrapping material includes greater than about 5 weight percent magnesium hydroxide, and the second wrapping material has an inherent permeability of about 20 CORESTA units or less.

28. The cigarette of claim 22 wherein the cigarette further includes air dilution means such that the cigarette is ventilated at least about 20 percent.

29. The cigarette of claim 22 or 28 wherein the cigarette has an air dilution of from about 30 percent to about 70 percent.

30. The cigarette of claim 22 wherein the basis weight of the second wrapping material is grater than about 45 $g/m^2$.

31. The cigarette of claim 22 wherein the organic acid is malic acid.

32. The cigarette of claim 22 wherein the alkali metal salt is potassium chloride.

33. The cigarette of claim 22 wherein the second wrapping material includes at least 1 weight percent malate ion.

34. The cigarette of claim 22 wherein the first wrapping material includes tobacco and wood pulp.

35. The cigarette of claim 22 or 34 wherein the first wrapping material includes inorganic filler.

36. The cigarette of claim 35 wherein the inorganic filler is calcium carbonate.

37. The cigarette of claim 22 wherein the alkali metal salt is potassium malate.

* * * * *